United States Patent [19]

Barker et al.

[11] 4,015,728

[45] Apr. 5, 1977

[54] MATERIAL HANDLING APPARATUS

[75] Inventors: Noble G. Barker, Pekin, Ill.; John E. Corwin, Portland, Ind.; Jimmy D. Myers, Morton, Ill.; Jan B. Yates, Reynoldsburg, Ohio

[73] Assignee: Caterpillar Tractor Co., Ill.

[22] Filed: Feb. 24, 1975

[21] Appl. No.: 552,393

[52] U.S. Cl. ..... 214/138 G; 92/33; 92/85 B

[51] Int. Cl.[2] ..... E02F 3/32

[58] Field of Search ..... 214/138 G; 92/31, 33, 92/85 B

[56] References Cited

UNITED STATES PATENTS

| | | | |
|---|---|---|---|
| 2,765,778 | 10/1956 | Gerry et al. | 92/31 |
| 3,213,760 | 10/1965 | Carr | 92/85 B |
| 3,393,610 | 7/1968 | Aarvold | 92/33 |
| 3,513,754 | 5/1970 | John | 92/31 |
| 3,758,941 | 9/1973 | Jackson et al. | 214/138 G |
| 3,805,672 | 4/1974 | Pekrul | 92/85 B |
| 3,844,197 | 10/1974 | Kramer et al. | 92/31 |

*Primary Examiner*—Robert J. Spar
*Assistant Examiner*—Ross Weaver
*Attorney, Agent, or Firm*—Wegner, Stellman, McCord, Wiles & Wood

[57] ABSTRACT

An improved hydraulic actuator for use as a swing motor in a material handling apparatus of the type having a vehicle mounted boom. Two embodiments are disclosed and each includes a vertically disposed, double-acting cylinder having an internal, vertically reciprocal piston. The cylinder may be disposed between yoke arms mounting a boom and provision is made for securing the cylinder to the vehicle frame. A coupling device is secured to one of the yoke arms and has a first splined surface while means are carried by the piston and movable therewith and include a second splined surface slidably engaging the first splined surface. The piston also carries a third splined surface which is in engagement with a fourth splined surface carried by either the cylinder or a part of the vehicle frame and at least one of the splined surfaces has a helical pitch so that reciprocation of the piston will cause rotation of the coupling device to thereby effect rotation of the yoke to swing a boom attached thereto about a generally vertical axis.

4 Claims, 3 Drawing Figures

MATERIAL HANDLING APPARATUS

BACKGROUND OF THE INVENTION

This invention relates to material handling apparatus and, more specifically, to material handling apparatus of the type wherein a boom is mounted on a vehicle and which further includes an improved swing motor for swinging the boom relative to the vehicle.

Prior art of possible relevance includes the following United States patents: Gerry et al U.S. Pat. No. 2,765,778; Davis U.S. Pat. No. 3,090,244; Rudd et al U.S. Pat. No. 3,190,190; Rumsey et al U.S. Pat. No. 3,195,421; Drake U.S. Pat. No. 3,215,046; Elliott et al U.S. Pat. No. 3,270,894; and Jackson et al U.S. Pat. No. 3,758,941.

Compactness and reliability through simplicity are and have been highly desirable qualities in material handling apparatus as, for example, in drive systems for booms mounted on vehicles. In vehicle mounted boom apparatus, there is almost universally a requirement that the boom be swingable about a vertical axis relative to the vehicle for positioning purposes. And, it is highly preferred that motor devices employed to swing the boom about such axis function in conjunction with swing pins mounting the boom for such movement on the axis.

Consequently, motors used for the purpose must be compact yet powerful and capable of being fitted within the connection of the boom to the vehicle to operate on such axis.

Moreover, because of such positioning and compactness, it is highly desirable that the motors be simple in construction so as to provide improved reliability by reason of such simplicity.

Typically, the motors employed are hydraulic motors. Because of the numerous and abrupt cyclic movement changes in use, as when the boom mounts a backhoe, they are subject to high fluid pressures and structural stresses. Such loads are cyclically borne by the seals employed with the result that premature wear and failure frequently occurs requiring all too frequent servicing.

SUMMARY OF THE INVENTION

It is the principal object of the invention to provide a new and improved material handling apparatus having a vehicle and a boom mounted for swinging movement therewith with an improved fluid motor for swinging the boom about a vertical axis relative to the vehicle. It is also an object of the invention to provide an improved rotary actuator particularly suited for use in such vehicle mounted boom apparatus.

An exemplary embodiment of the invention achieves the foregoing objects in a structure including a boom defined by first and second elongated, pivotally interconnected arms. One of the arms supports the material handling device while the other of the arms is connected to a bifurcated yoke having a pair of vertically spaced, horizontally extending arms. The arms are mounted to a portion of the vehicle to carry the boom and means are provided whereby the yoke arms may rotate relative to the vehicle about a generally vertical axis. A vertically disposed, double-acting hydraulic cylinder having an internal, vertically reciprocable piston is disposed between the yoke arms and is secured to the vehicle frame against rotation. A coupling device is secured to one of the yoke arms and has a first splined surface. A second splined surface is carried by the piston and is movable therewith and engages the first splined surface.

The piston also carries a third splined surface which is in sliding engagement with a fourth splined surface which may be carried either by the cylinder or the vehicle frame. One of the splined surfaces has a helical pitch so that reciprocation of the piston within the cylinder will cause rotation of the coupling device to thereby effect rotation of the yoke.

According to one embodiment of the invention, the piston carries a piston rod extending exteriorly of the cylinder and the rod, exteriorly of the cylinder, carries the second and third splined surfaces mentioned previously. According to this embodiment, the coupling device forms part of a journalling assembly whereby the boom is pivotally mounted on the vehicle frame and includes a bore having the first splined surface slidably receiving the piston rod end and the second splined surface. The fourth splined surface is carried by the frame of the vehicle and is in engagement with the third splined surface on the piston rod.

According to another embodiment of the invention, the piston is rotatable within the cylinder and includes an internal bore, the internal bore being provided with the second splined surface. The coupling device comprises an elongated shaft extending through and journalled in the cylinder and which further extends through the bore. The first splined surface extends along the shaft within the cylinder. According to this embodiment, the third splined surface is on a radially outer surface of the piston, while the fourth splined surface is carried on the interior wall of the cylinder.

In a highly preferred form of this embodiment, the first splined surface extends along only one portion of the shaft and the second splined surface is located only at one end of the bore of the piston. A seal is provided within the bore at the opposite end of the piston and sealingly engages a portion of the shaft other than that having the first splined surface thereon.

Similarly, on the radially outer surface of the piston, seals are provided at but one end thereof and the other end carries the third splined surface. In this way, the number of seals is minimized, providing for substantially improved and reliable operation.

A highly preferred embodiment of the invention also provides means for cushioning the piston at opposite ends of its stroke within the cylinder. In the preferred embodiment, the cushioning means are hydraulically operated valves which are closed by piston movement as it approaches the end of its stroke to close a main flow path forcing fluid to pass through a restricted flow path, thereby cushioning movement of the piston.

Other objects and advantages will become apparent from the following specification taken in connection with the accompanying drawings.

DESCRIPTION OF THE PREFERRED EMBODIMENTS

Figure 1:
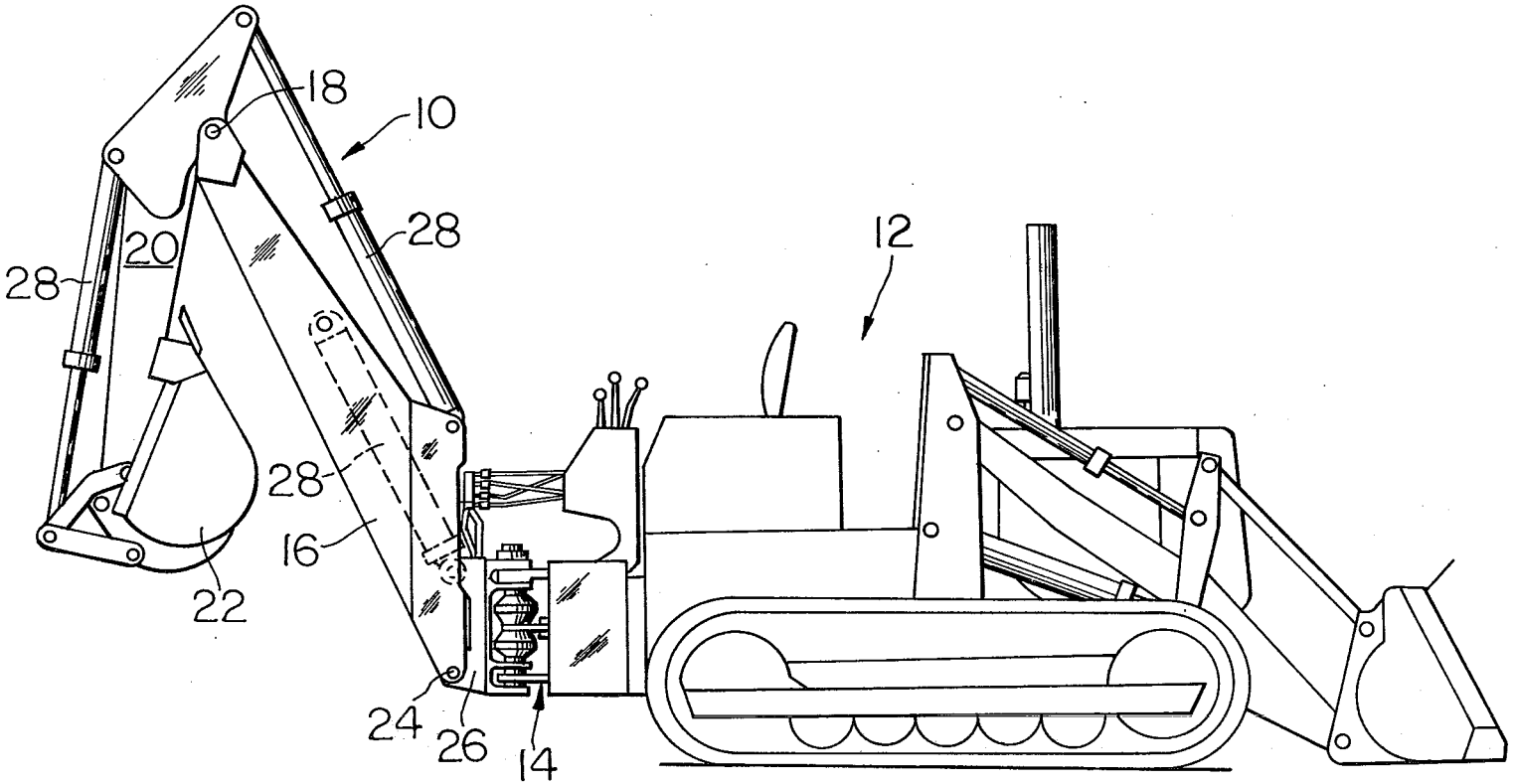
FIG. 1 is a side elevation of a material handling apparatus made according to the invention.

With reference to FIG. 1, an exemplary embodiment of a material handling apparatus made according to the invention is illustrated and is seen to include a boom structure, generally designated 10, mounted on a vehicle, generally designated 12, in such a way that it may be rotated about a generally vertical axis by a hydraulic actuator, generally designated 14. The boom 10 may be formed in any suitable manner, but according to the exemplary embodiment of the invention, includes a first boom arm 16 pivotally connected as at 18 to a second boom arm 20 which, in turn, mounts material handling apparatus 22 in the form of a bucket. The boom arm 16 is pivotally connected as at 24 to a yoke 26 which, in turn, is journalled to the frame of the vehicle 12 by means to be described in greater detail hereinafter. As is well known in the art, a variety of hydraulic cylinders may be provided for controlling the relative positioning of the arm 16, the arm 20 and the bucket 22 relative to each other and to the vehicle 12 about horizontal axes. Hydraulic cylinders 28 are provided for this purpose.

The vehicle 12 is shown as a crawler-type tractor of conventional construction. In this connection, it is to be specifically understood that while a crawler-type vehicle and a boom of the so-called "backhoe" type have been shown herein, the invention is not to be limited to use with particular type of vehicle or particular type of boom. For example, it is contemplated that a vehicle such as a garbage truck could employ a boom similar to that illustrated with the exception that a grapple be substituted for the bucket 22 within the spirit of the invention.

Figure 2:
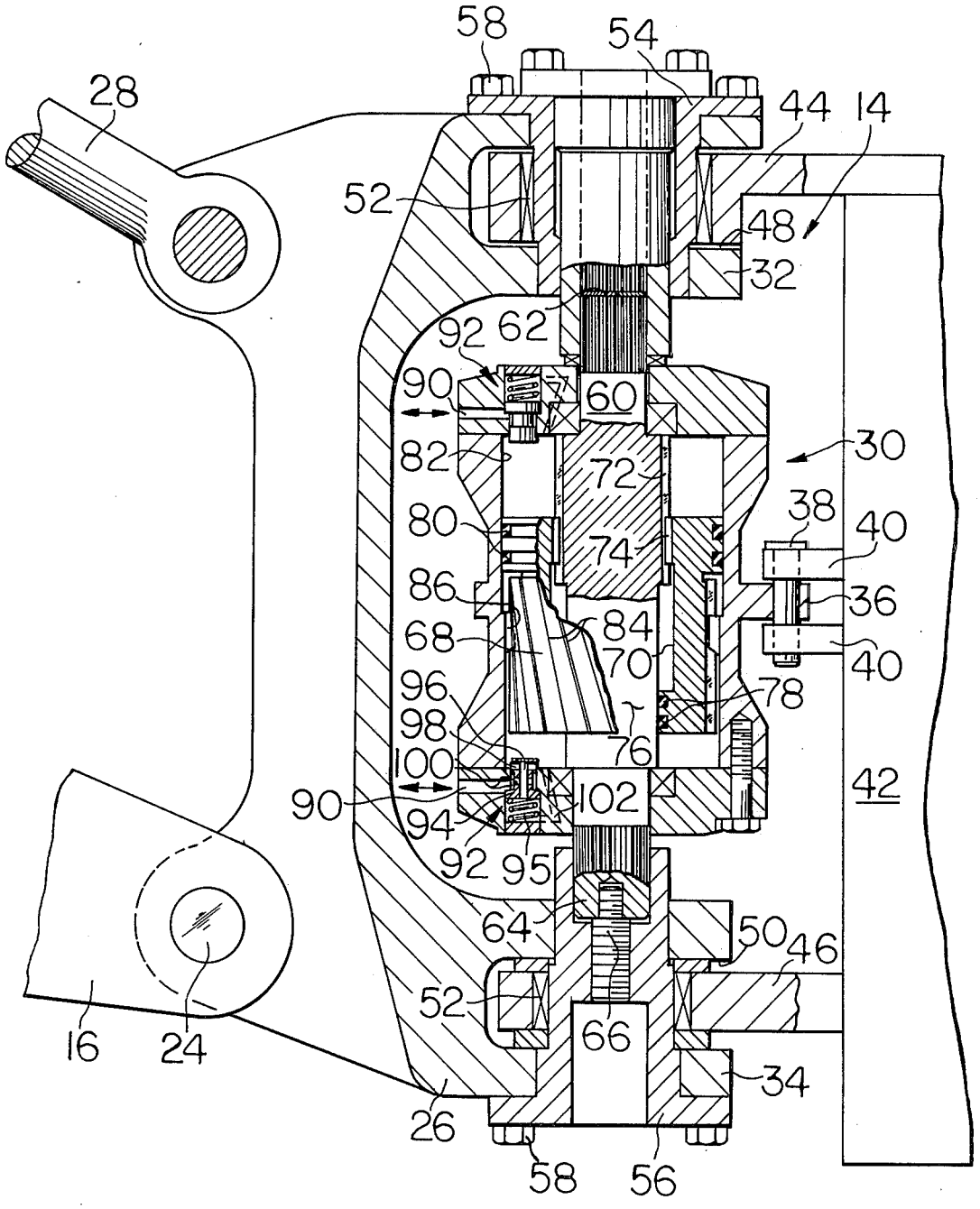
FIG. 2 is an enlarged, vertical section of a hydraulic actuator for swinging the boom of the material handling apparatus relative to the vehicle on which the boom is mounted.

Turning now to FIG. 2, one embodiment of the hydraulic actuator 14 will be described in greater detail. The same includes a double-acting, hydraulic cylinder, generally designated 30, disposed between two vertically spaced, horizontally extending arms 32 and 34 of the yoke 26. The exterior of the cylinder 30 includes a horizontally projecting tongue 36 which may be secured by means of a pin 38 to a pair of tongues 40 secured to a part of the frame 42 of the vehicle 12. The purpose of this construction is to preclude rotation of the cylinder 30 relative to the vehicle 12.

The vehicle frame 42 includes horizontally extending arms 44 and 46 which are received in slots 48 and 50 in the yoke arms 32 and 34, respectively. The arms 44 and 46 mount bearings 52 for journalling a coupling device composed of upper and lower sleeves 54 and 56, respectively, which are secured as by bolts 58 to the yoke arms 32 and 34 respectively. The coupling device also includes a vertically extending shaft 60 which is splined to the sleeves 54 and 56 at its upper and lower ends 62 and 64, respectively. If desired, a threaded connection provided by a stepped bolt 66 may be provided at one end to preclude axial shifting of the shaft 60.

As can be seen from FIG. 2, the pivot axis of the boom relative to the frame is defined by the longitudinal axis of the shaft 60 by reason of its placement with respect to the bearings 52.

Within the cylinder 30 is a rotary and reciprocal piston 68 having an internal bore 70 through which the shaft 60 extends. The upper end of the shaft 60 includes a first splined surface 72 which is in sliding engagement with a second splined surface 74 on the interior of the bore 70 near one end of the piston 68.

That portion of the shaft 60 within the cylinder 30 and below the splined surface 72 is designated 76 and is smooth. The end of the bore 70 opposite the second splined surface 74 is provided with sealing means 78 in sliding engagement with the shaft portion 76.

On the radially outer surface of the piston 68 and at the upper end thereof, sealing means 80 are in sealing engagement with the interior surface 82 of the cylinder 30. Thus, it will be appreciated that the seals 78 and 80 establish a fluid seal across the piston from one end to the other to eliminate leakage.

The end of the piston 68 opposite from the seals 80 includes a third splined surface defined by grooves 84 which are helical or at least non-parallel to the longitudinal axis of the shaft 60.

A fourth splined surface defined by lugs 86 projecting inwardly from the interior surface of the cylinder 30 and into the grooves 84 establishes a slidable splined connection. It is to be specifically noted that the location of the lugs 86 is located nearer to the end of the cylinder 30 that is adjacent the splined end of the piston 68 than the cylinder end closest to the end of the piston 68 bearing the seals 80.

As a result of the foregoing construction, when fluid under pressure is applied to one or the other side of the piston 68, the same will be reciprocated within the cylinder 30. By reason of the pitch of the third splined surface defined by the grooves 84 and their engagement with the splined surface 86, the piston will be caused to rotate during such reciprocation. The rotation, in turn, will be directed to the shaft 60 by reason of its splined interconnection to the piston by reason of the presence of splined surfaces 72 and 74. Consequently, the shaft 60 will be caused to rotate to thereby rotate the sleeves 54 and 56. Rotation of the sleeves 54 and 56 will, in turn, cause rotation of the yoke 26 and the boom 10 about the vertical axis defined by the shaft 60.

While, as illustrated in FIG. 2, the splined surfaces 72 and 74 extend parallel to the axis of rotation of the shaft 60, if a greater degree of rotation of the shaft 60 is desired, the first splined surface 72 could be provided with a helical pitch in a direction opposite from the pitch of the third splined surface defined by grooves 84. For example, if a particular pitch of the third splined surface provided 180° of rotation of the shaft 60 for a full stroke of the piston 68 within the cylinder 30, 360° of rotation could be achieved by providing a pitch in the splined surface 72 equal but opposite to that of the third splined surface.

According to the embodiment illustrated in FIG. 2, means are provided for cushioning the piston 68 adjacent each end of its stroke so as to slow rotation of the shaft 60 to an acceptable rate to preclude damage due to inertial forces as the boom 10 is pivoted between its extreme positions of movement. Each end of the cylinder 30 is provided with a fluid flow port which, by suitable controls, not shown, can be alternately connected to a source of fluid under pressure or to a fluid reservoir depending upon the desired direction of piston movement. Disposed in each end of the cylinder 30 is a valve, generally designated 92, which operates to provide the aforementioned cushioning function. Since the structure of each valve 92 is identical, one to the other, only the lowermost one illustrated in FIG. 2 will be described.

Each valve includes a valve member 94 normally biased to the position shown by a spring 95 which corresponds to a normally open position. The valve member includes an axial passage 96 which opens at both ends of the valve member 94. The passage 96 is in fluid communication with a first radical valve passage 98 and a second radial valve passage 100 which is configured to be in continuous fluid communication with the port 90 regardless of the position of the valve member 94.

A restricted fluid flow passage which may include an orifice (not shown) or the like, is designated 102 and extends from the interior of the cylinder 30 at an end thereof to the bore receiving the valve member 94 adjacent the spring 96. In normal operation, fluid may pass freely to or from the port 90 via the axial passage 96 and the radial passage 98 through the second radial passage 100. However, as the piston moves toward the end of its path of travel, it will engage the valve member 94. This will result in the preclusion of fluid flow into the valve member 94 through the open end of the axial passage 96. However, fluid will continue to be directed to the corresponding port 90 through the radial passage 98. As the piston continues to move, the valve member 94 will be pushed against the bias of the spring 95 until the radial passage 98 is wholly within the cylinder end thereby precluding fluid from passing therethrough to the port 90. At this point, fluid may only pass to the port 90 through the restricted fluid flow passage 102. By reason of the restriction in that passage, the fluid can flow to the port 90 only relatively slowly thereby slowing piston movement and providing a cushioning effect.

From the foregoing description, it will be appreciated that a hydraulic actuator made according to the first embodiment of the invention achieves the foregoing objects in that it is simple in construction and is compact as well. It is to be particularly noted that the unique construction of the piston enables the provision of seals only at a single end thereof. At the same time, the use of the cushioning means to slow piston movement and thereby slow boom movement minimizes inertial forces in the system as the boom is being moved thereby minimizing the surging of pressure within the piston due to inertial forces. As a result, a highly reliable, simple and compact actuator is provided.

Figure 3:
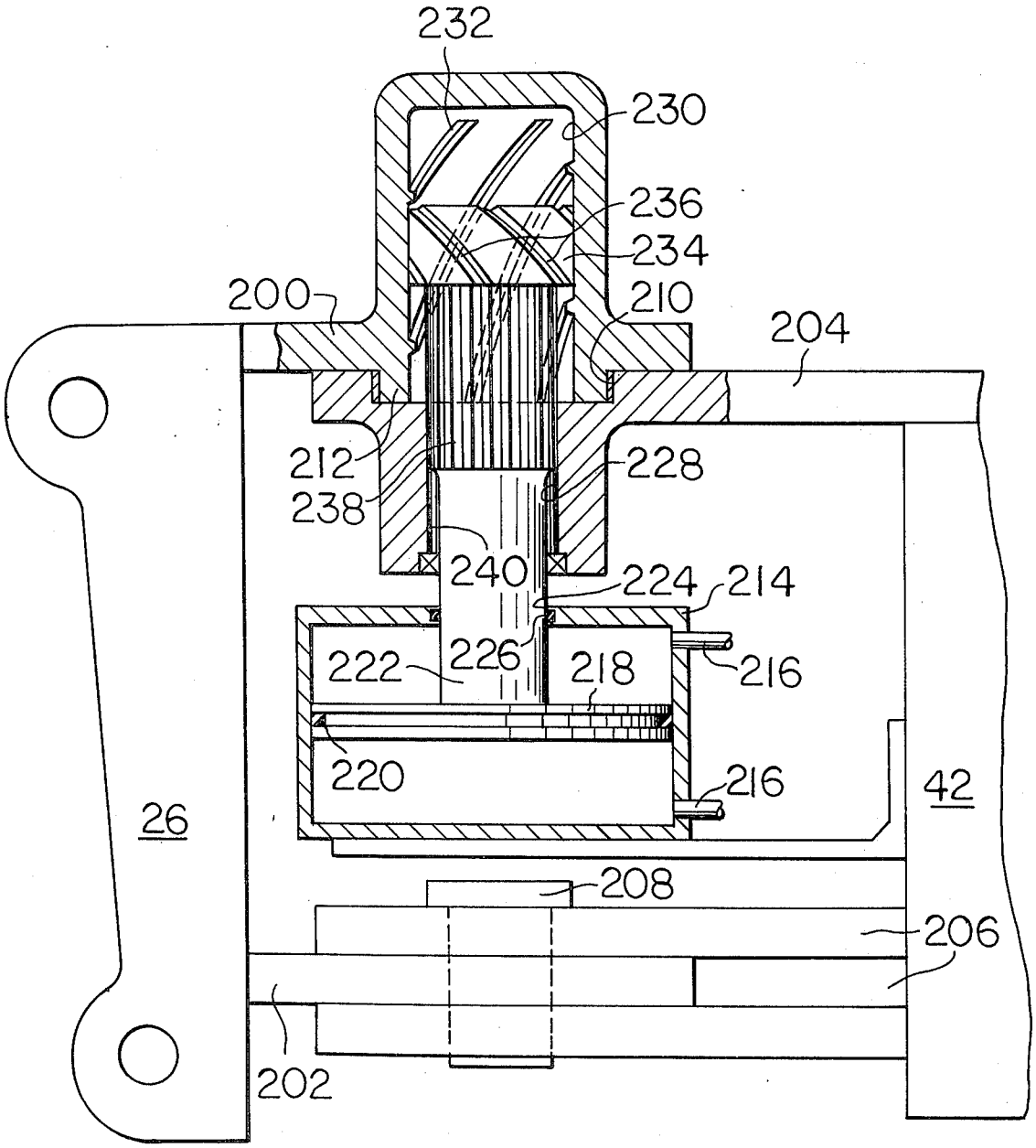
FIG. 3 is a modified embodiment of the hydraulic actuator.

Turning now to FIG. 3, a modified embodiment of the invention will be described. As in the case of the previously described embodiment, the yoke 26 is provided with vertically spaced, horizontally extending arms 200 and 202. In a like manner, the vehicle frame portion 42 is provided with horizontally extending arm structures 204 and 206. The arm 202 is journalled to the arm structure 206 by means of a suitable structure such as a pivot pin 208 and bearings (not shown) to establish a vertical pivot axis for the yoke 26. A recess 210 in the arm structure 204 pivotally receives a collar 212 integral with the arm 200 for rotation about the same vertical pivot axis. Again, if desired, suitable bearings may be provided.

The actuator, according to this embodiment, includes a double-acting, hydraulic cylinder 214 having fluid ports 216 at opposite ends thereof. Within the cylinder 214 is a reciprocal piston 218 provided with a seal 220 in engagement with the interior wall of the cylinder 214. A piston rod 222 is secured to the piston 218 to be movable therewith. It extends through a bore 224 in one end of the cylinder 214 and has a smooth surface for sealing engagement with a suitable seal 226.

The piston rod 222 extends into and through a bore 228 in the arm structure 204 into a further bore 230 in the upper arm 200 of the yoke 26. The interior surface of the bore 230 is provided with inwardly directed projections 232 which are helically pitched and define a first splined surface. The uppermost end of the piston rod 222 carried an enlarged segment 234 which is provided with grooves 236 which receive the projections 232 and which are helically pitched to define a second splined surface in engagement with the first splined surface.

Just below the cap 234 and extending to the smooth lower portion of the piston rod 222 is a linear, third splined surface 238 which is in engagement with a fourth, linear splined surface 240 formed within the interior of the bore 228.

As a result of the foregoing construction, it will be seen that as the piston 218 is reciprocated within the cylinder 214, it is produced from rotating relative to the vehicle by reason of the interaction of the third and fourth splined surfaces 238 and 240, respectively. Consequently, by reason of the pitch given to the first and second splined surfaces defined by the projections 232 and grooves 236, rotation will be imparted to the coupling device defined by the bore 230 and appurtenant structure and thus to the yoke 26. Consequently, the boom will be rotated in a direction dependent upon the direction of piston travel within the cylinder 214.

While not shown herein, it is to be understood that the embodiment of FIG. 3 can be provided with cushioning means such as those described previously in connection with FIG. 2.

It will also be appreciated that the embodiment illustrated in FIG. 3 possesses all of the advantages which fulfill the objects of the invention previously set forth in connection with the description of the embodiment illustrated in FIG. 2.

While the invention has been described and illustrated as having the hydraulic cylinder located between yoke arms, those skilled in the art will recognize that the cylinder could be mounted above or below either yoke arm without departing from the spirit of the invention.

We claim:

1. A material handling apparatus, comprising: a boom including first and second elongated arms; means pivotally interconnecting said boom arms; a material handling means; means pivotally connecting said material handling means to one of said boom arms; a bifurcated yoke; means pivotally connecting the other of said boom arms to said yoke, said yoke having a pair of vertically spaced, generally horizontally extending arms; a vehicle frame portion for mounting said yoke; means pivotally interconnecting said yoke arms to said vehicle frame portion for rotation about a generally vertical axis; a vertically disposed, double-acting cylinder having an internal, vertically reciprocal piston and supported by said yoke arms; means securing said cylinder against rotation to said vehicle frame portion; a coupling device secured to at least one of said yoke arms and having a first splined surface; means carried by said piston and movable therewith and having a second splined surface slidably engaging said first splined surface; means carried by said piston and movable therewith and defining a third splined surface; means carried by one of said cylinder and said vehicle frame portion and defining a fourth splined surface in sliding engagement with said third splined surface; at least one said splined surfaces having a helical pitch whereby reciprocation of said piston within said cylinder will cause rotation of said coupling device thereby effecting rotation of said yoke to ultimately swing said boom and said material handling means about said generally vertical axis; a piston rod connected to said piston for movement therewith, said rod having an end extending exteriorly of said cylinder; said second and third splined surfaces are located on said rod end; said vehicle frame portion including a journal assembly pivotally mounting one of said yoke arm and constituting said means pivotally interconnecting said yoke arms to said vehicle frame portion; said journal assembly including a bore slidably receiving said piston rod end, the interior of said bore being provided with said fourth splined surface.

2. A material handling apparatus, comprising: a boom including first and second elongated arms; means pivotally interconnecting said boom arms; a material handling means; means pivotally connecting said material handling means to one of said boom arms; a bifurcated yoke; means pivotally connecting the other of said boom arms to said yoke, said yoke having a pair of vertically spaced, generally horizontally extending arms; a vehicle frame portion for mounting said yoke; means pivotally interconnecting said yoke arms to said vehicle frame portion for rotation about a generally vertical axis; a vertically disposed, double-acting cylinder having an internal, vertically reciprocal piston and supported by said yoke arms; means securing said cylinder against rotation to said vehicle frame portion; a coupling device secured to at least one of said yoke arms and having a first splined surface; means carried by said piston and movable therewith and having a second splined surface slidably engaging said first splined surface; means carried by said piston and movable therewith and defining a third splined surface; means carried by one of said cylinder and said vehicle frame portion and defining a fourth splined surface in sliding engagement with said third splined surface; at least one of said splined surfaces having a helical pitch whereby reciprocation of said piston within said cylinder will cause rotation of said coupling device thereby effecting rotation of said yoke to ultimately swing said boom and said material handling means about said generally vertical axis; a piston rod connected to said piston for movement therewith, said rod having an end extending exteriorly of said cylinder; said second and third splined surfaces are located on said rod end; one of said yoke arms including a bore receiving said piston rod end, said bore being provided with said first splined surface.

3. A material handling apparatus, comprising: a boom including first and second elongated arms; means pivotally interconnecting said boom arms; a material handling means; means pivotally connecting said material handling means to one of said boom arms; a bifurcated yoke; means pivotally connecting the other of said boom arms to said yoke, said yoke having a pair of vertically spaced, generally horizontally extending arms; a vehicle frame portion for mounting said yoke; means pivotally interconnecting said yoke arms to said vehicle frame portion for rotation about a generally vertical axis; a vertically disposed, double-acting cylinder having an internal, vertically reciprocal piston and supported by said yoke arms; means securing said cylinder against rotation to said vehicle frame portion; a coupling device secured to at least one of said yoke arms and having a first splined surface; means carried by said piston and movable therewith and having a second splined surface slidably engaging said first splined surface; means carried by said piston and movable therewith and defining a third splined surface; means carried by one of said cylinder and said vehicle frame portion and defining a fourth splined surface in sliding engagement with said third splined surface; at least one of said splined surfaces having a helical pitch whereby reciprocation of said piston within said cylinder will cause rotation of said coupling device thereby effecting rotation of said yoke to ultimately swing said boom and said material handling means about said generally vertical axis; a piston rod connected to said piston for movement therewith, said rod having an end extending exteriorly of said cylinder; said second and third splined surfaces are located on said rod end; one of said yoke arms and said vehicle frame portion having aligned bores coincident with said vertical axis and both receiving said piston rod end; said first splined surface being within said yoke arm bore and said fourth splined surface being within said vehicle frame portion bore.

4. A hydraulic actuator for use in rotating an element such as a boom or the like, said hydraulic actuator comprising: a cylinder having opposed ends; an elongated shaft extending through said cylinder and journalled within said ends, said shaft having a first splined surface within said cylinder and extending partially along the length of said shaft from one end of said cylinder; a piston rotatably and reciprocally received within said cylinder, said piston having opposite ends and an internal bore, said internal bore, at one of said piston ends adjacent said cylinder one end, carrying an internal second splined surface in engagement with said first splined surface, said bore at said piston end opposite said piston one end carrying a seal in sliding, sealing engagement with said shaft at an unsplined portion thereof within said cylinder; a further seal carried by said piston on the radially outer surface thereof adjacent said piston one end and sealingly, slidably engaging said cylinder adjacent said cylinder one end; a third splined surface carried by said piston opposite end; and a fourth splined surface in engagement with said third splined surface carried by said cylinder within the interior thereof, said fourth splined surface being disposed closed to the end of said cylinder opposite said cylinder one end than to said cylinder one end, at least one pair of said engaged splined surfaces having a helical pitch; each end of said cylinder being provided with a hydraulic fluid flow port and a normally open valve reciprocally mounted in each hydraulic fluid flow port for normally permitting free flow of hydraulic fluid into or out of said cylinder and a restricted hydraulic fluid flow port bypassing the corresponding one of said valves; each said valve having a portion extending into said cylinder to be engaged by said piston so that the valve will be progressively closed as said piston approaches the corresponding end of said cylinder to thereby force hydraulic fluid to flow out of said cylinder through said restricted hydraulic fluid flow port to thereby hydraulically cushion piston movement at both ends of its path of travel within said cylinder.

* * * * *